United States Patent [19]

Barford et al.

[11] Patent Number: 4,460,490

[45] Date of Patent: Jul. 17, 1984

[54] LAVATORY CLEANSING BLOCKS

[75] Inventors: Eric D. Barford, Stanton; Daniel J. Jeffrey; Paul A. Raynor, both of Thetford, all of England

[73] Assignee: Jeyes Group Limited, England

[21] Appl. No.: 331,822

[22] Filed: Dec. 17, 1981

[30] Foreign Application Priority Data

Dec. 18, 1980 [GB] United Kingdom ..... 8040679

[51] Int. Cl.[3] ..... C11D 13/14

[52] U.S. Cl. ..... 252/92; 252/91; 252/94; 252/134; 252/174; 252/174.13; 252/174.17; 252/DIG. 16; 252/186.25; 252/186.34; 252/186.35

[58] Field of Search ..... 252/90, 174, 134, 174.13, 252/DIG. 16, 95, 99, 106, 94, 91, 92, 186.25; 4/222, 227, 228; 222/190; 264/75, 240, 241

[56] References Cited

U.S. PATENT DOCUMENTS

| | | | |
|---|---|---|---|
| 1,601,775 | 10/1926 | Scherieble | 252/DIG. 16 |
| 1,791,359 | 2/1931 | Henriksen | 252/134 |
| 3,294,692 | 12/1966 | Kelly et al. | 252/174 |
| 3,856,932 | 12/1974 | May | 252/134 |
| 3,925,225 | 12/1975 | Morrison | 252/DIG. 16 |
| 3,962,107 | 6/1976 | Levin et al. | 252/95 X |
| 4,043,931 | 8/1977 | Jeffrey et al. | 252/90 X |
| 4,192,763 | 3/1980 | Buchan . | |
| 4,200,606 | 4/1980 | Kitko | 252/174 |
| 4,256,599 | 3/1981 | Krisp et al. | 252/174 X |

FOREIGN PATENT DOCUMENTS 977194 3/1951 France .

OTHER PUBLICATIONS

Chlorine, Hackh's Chemical Dictionary, p. 193, Third Edition, McGraw-Hill Comp.

*Primary Examiner*—John E. Kittle
*Assistant Examiner*—Hoa Van Le
*Attorney, Agent, or Firm*—Stevens, Davis, Miller & Mosher

[57] ABSTRACT

A free-standing lavatory cleansing block for immersion in the cistern of a lavatory comprises a shaped body (1) formed of a slow-dissolving cleaning composition containing at least one surface active agent and a tablet (2) comprising a bleaching agent embedded in or adhered to the shaped body.

3 Claims, 12 Drawing Figures

LAVATORY CLEANSING BLOCKS

This invention is concerned with improvements in and relating to lavatory cleansing blocks.

In particular, the invention is concerned with lavatory cleansing blocks of the type which are intended to be immersed in the cistern of a lavatory or urinal so that they dissolve in the water in the cistern to release active cleansing ingredients to the water which is subsequently flushed from the cistern into the lavatory bowl or urinal. More particularly, the invention is concerned with such blocks which are immersed in the cistern in non-containerised or free-standing form, i.e. blocks which are placed in the cistern without any container or protective material except possibly (as discussed below) a temporary water-soluble wrapping which is dissolved away by the water in the cistern.

According to the invention there is provided a lavatory cleansing block comprising a shaped body formed of a slow-dissolving cleaning composition containing at least one surface active agent and a tablet comprising a bleaching agent, the bleaching agent tablet being embedded in or adhered to the shaped body.

In the following description reference will be made to the accompanying drawings in which.

Figure 1:
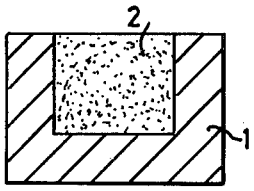
FIG. 1 is a cross-section through a first simple embodiment of block in accordance with the invention.

In the drawings, numeral 1 indicates a shaped body of a slow-dissolving cleansing composition containing at least one surface active agent, numeral 2 represents a tablet comprising a bleaching agent; numeral 3 represents a film of a readily water-soluble or water dispersible material; numeral 4 represents a readily water-soluble or water dispersible material; numeral 5 represents a mould cup; numeral 6 represents a lid for mould cup 5; and numerals 7 and 8 indicate shaped body portions formed of different slow-dissolving composition (one of which at least is a slow-dissolving cleansing composition containing a surface active agent), the two portions 7 and 8 together forming a shaped body 1.

The blocks shown in the drawings will most conveniently be circular in plan but may be of any desired configuration, e.g. polygonal or curvilinear in plan.

In a simple embodiment, as shown in FIGS. 1, 6, 8, 9 and 10 of the drawings, a block in accordance with the invention simply comprises a bleaching agent tablet 2 embedded in a body of slow dissolving cleansing composition 1. However it has been found that on storage bleaching agent at the surface of tablet 2 in contact with cleansing composition 1 may react slightly (depending upon the nature of the bleaching agent and the cleansing composition) to cause local discoloration of the cleaning composition. Whilst it has been found that such reaction is generally only of a minor nature and has no marked effect on the performance of the block it will be appreciated that such discoloration may offend the potential user and thus it may be desirable to isolate the tablet 2 from contact with the cleaning composition, for example by providing it with a film coating 3 of readily water-soluble or water-dispersible material (see FIG. 2) or by enrobing it in a layer of readily water-soluble or water-dispersible material 4 (see FIG. 3). Such a protective coating of water-soluble or water-dispersible material also serves to protect the tablet from ambient atmospheric moisture and thus only the exposed face (i.e. that face not masked by the cleaning composition 1) of tablet 2 may be so protected, for example as shown in FIGS. 4 and 5 of the drawings. Alternatively, only those portions of the tablet 2 in contact with shaped body 1 may be provided with a coating of readily water-soluble or water dispersible material 4.

In operation, the block is placed in the cistern of a lavatory or urinal, preferably with the base of the shaped body downwards, so that it rests on the bottom of the cistern. (In this connection it may be noted that it is generally preferred to locate the block in that part of the cistern remote from the water inlet of the cistern to avoid direct impingement of a stream of water upon the block when the cistern is being refilled after flushing. It may also be noted that the block should have a density greater than that of water so that it does not float in the water of the cistern.

A part of the surface of tablet 2 is then in contact with water in the cistern when the tablet is not provided with a protective coating (as shown in FIGS. 1, 6, 7, 8, 10, 11 and 12) or a part of the surface of tablet 2 is exposed to water in the cistern by dissolution or dispersion of all or a part of the protective film or layer of readily water-soluble or water-dispersible material (as shown in FIGS. 2, 3, 4 and 5).

Where the tablet 2 is wholly enrobed by the composition of shaped body 1 (see FIG. 9) the solubility and/or thickness of the layer of composition separating the tablet from the water is preferably such that bleaching agent is liberated to the water in less than 48 hours, preferably in less than 24 hours.

Thus, any protective film or coating surrounding the bleaching agent tablet should be formed of a material which dissolves or disperses away to expose at least a part of the surface of the bleacing agent tablet 2 or to permit release of bleaching agent to the water in a period of preferably less than 48 hours. Clearly the period of time within which a part of the surface of the tablet 2 is exposed will depend not only upon the solubility characteristics of the material surrounding it but also upon the thickness of that part of the material protecting the surface of the tablet from the water.

On immersion a part of the cleaning composition of shaped body 1 is dissolved in the water in the cistern to release surface active agent thereto. As a result, the water in the cistern is provided with two cleansing agents (bleaching agent and surface active agent) dissolved or dispersed therein and, on flushing, this water is brought into contact with the lavatory bowl or urinal to clean it.

The components of the block should have controlled water solubility characteristics. Thus the shaped body should be formed of a slow dissolving composition and desirably the rate of dissolution of the composition and the amount of composition in the block should be such that the shaped body slowly dissolves away, in use, over a period of days, or, preferably weeks. We have found that, in practice, a shaped body which dissolves away, in average household use (e.g. from 5 to 20 flushes per day), at an average rate of about 1 to 10 grams per day, more preferably 2 to 3 grams per day, is particularly useful.

As will be appreciated the desired rate of dissolution will depend on the size of the block, generally the greater the size of the block the higher its dissolution rate and vice versa.

The blocks of the invention suitably have a weight of from 30 to 300 grams, preferably from 50 to 100 grams, more preferably 70 to 80 grams. The relative weight of shaped body and bleach tablet may vary within wide limits depending on the nature of the materials and the amount of ingredients other than surface active agents or bleaching agents in each.

The tablet 2 should, desirably, have a dissolution or bleaching agent release rate such that it is exhausted, i.e. ceases to liberate bleaching agent, at about the same time as shaped body 1 has completely dissolved or in certain embodiments, as discussed more fully below, shortly before the shaped body has completely dissolved.

The blocks of the invention may be produced by a variety of processes and the process adopted will, to a large extent, depend upon the process used to manufacture the shaped body of slow-dissolving cleansing composition. Thus, the shaped body may be manufactured by a casting/moulding process, by tablet compression process or by an extrusion process.

In the casting/moulding process a melt of the ingredients for forming the shaped body is cast into an appropriately shaped mould and allowed to cool to form a shaped body of the desired configuration. In such a process the moulded shaped body may be provided with an appropriately shaped recess to accommodate the bleach tablet which is subsequently introduced into that recess. However, when employing a casting-/moulding process it is generally preferred to mould the shaped body around a preformed bleach tablet.

Figure 7:
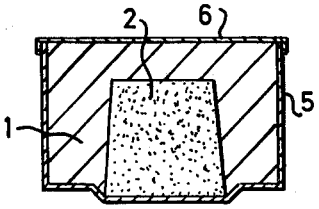
FIG. 7 is a cross-section through a block illustrated in FIG. 1 in a container serving as a mould for the block.
Figure 8:
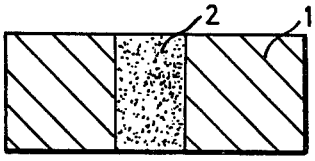
FIG. 8 is a cross-section through a block having a bleaching agent tablet extending therethrough.
Figure 9:
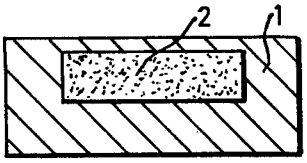
FIG. 9 is a cross section through a block having a bleaching agent tablet wholly embedded therein.
Figure 10:
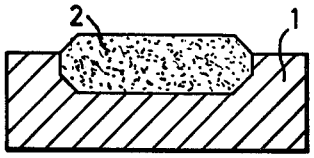
FIG. 10 is a cross-section through a block having a bleaching agent tablet partially embedded therein.

Thus blocks of the type illustrated in FIGS. 1,6,7,8 and 10 of the drawings may be prepared by firstly introducing a bleaching agent tablet into the bottom of a suitable mould (for example a mould cup 5 as shown in FIG. 7 of the drawings), then pouring a melt of a material to form shaped body 1 into the mould, and finally allowing the molten material to solidify, if desired under forced cooling conditions. The block may then be removed from the mould for further packaging. However, in accordance with one embodiment of the invention, the mould itself is used as the packaging for the block, being later provided with a lid 6, as shown in FIG. 7 of the drawings. The block is readily removed from the mould cup 5 by the user, after removal of lid 6, for introduction into the lavatory cistern. In this case, mould cup 6 is suitably formed of a plastics material such as polyethylene, polyvinylchloride, polypropylene or polystyrene.

Figure 11:
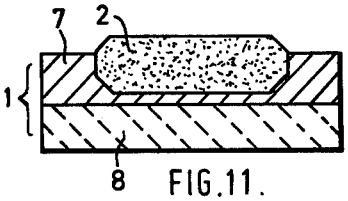
FIGS. 11 and 12 are cross-sections through blocks similar to that shown in FIG. 10 but in which the body of the shaped body comprises two portions of different cleansing compositions.
Figure 12:
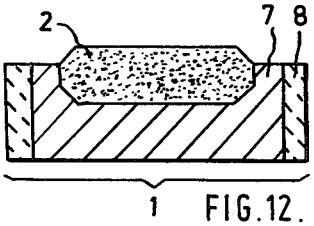

Blocks of the type shown in FIGS. 11 and 12 of the drawings may be produced in a similar manner except that a second melt (to form shaped body portion 7) is introduced into the mould after the first melt (to form shaped body portion 8) has set.

Figure 2:
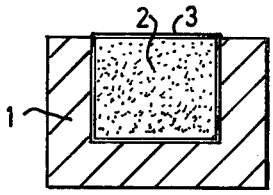
FIG. 2 is a cross-section through a second embodiment of block in accordance with the invention in which the tablet comprising the bleaching agent is surrounded by a film of a readily water-soluble or water-dispersible material.

Blocks of the type shown in FIG. 2 of the drawings, in which the tablet is coated with a film 3 of water-soluble or water dispersible material, may be produced in a similar manner except that tablet 2 is first provided with film coating 3 before introduction into the mould.

Figure 3:
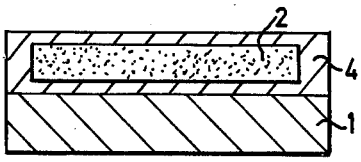
FIG. 3 is a cross-section through a third embodiment of block in accordance with the invention in which the tablet comprising the bleach agent is contained in a layer of a readily water-soluble or water-dispersible material in contact with one face of the shaped body of slow-dissolving cleansing compositions.
Figure 4:
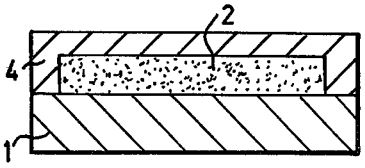
FIGS. 4 and 5 are cross-sections through modifications of the block illustrated in FIG. 3.
Figure 5:
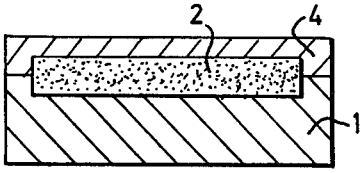
Figure 6:
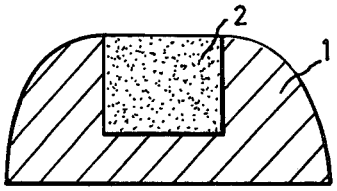
FIG. 6 is a cross-section through a modification of the blocks shown in FIG. 1, illustrating another shape for the shaped body.

Blocks of the type shown in FIGS. 3, 4 and 5 of the drawings may be produced by an operation comprising the steps of:

(1) pouring a melt of the material 4 into a mould so that at least the lower part of the material is cooled to a solid or semisolid state;

(2) introducing a bleach tablet 2 into the mould;

(3) optionally introducing further molten material 4 to cover tablet 2;

(4) introducing a melt of the shaped body cleansing composition 1 into the mould; and (5) allowing the block to set in the mould.

Step 3 noted above is an optional step in that if the tablet 2 is introduced into the mould before the composition 4 therein has wholly set, it will, if it is of greater density than composition 4—as will generally be the case, sink therein to become partly or wholly enrobed with the material 4.

Alternatively a reverse sequence of steps may be followed by first pouring into the mould the melt to form shaped body 1, allowing this to set, introducing tablet 2, then introducing a melt of material 4 and finally allowing the melt to set in the mould.

In a tablet compression process, a free-flowing particulate mixture of the ingredients to form the shaped body is introduced into an appropriately shaped die and then compressed therein to form a shaped body. In this case the shaped body may be formed with an appropriately shaped recess to accommodate the bleach tablet which is subsequently introduced therein. Alternatively the bleach tablet, provided it has sufficient compressive strength, may be introduced into the die and the particulate mixture then introduced into the die and compressed therein to provide a shaped body having the bleach tablet embedded therein. The tablet compression process is in general most suitable for the production of blocks as shown in FIGS. 1, 2, 6,7, 8 and 10 of the drawings.

In an extrusion process, a mixture of the ingredients for forming the shaped body is introduced into an extruder and extruded therefrom to form a continuous rod of solid composition which is then cut into properly sized portions. The bleach tablets may then be pressed into the portions before these latter have completely hardened, e.g. while they are set but still maleable. Alternatively recesses may be stamped in the portions and the bleach tablets then introduced into these portions. The extrusion process is generally most suitably for the production of blocks as shown in FIGS. 1, 2, 6,7, 8 and 10 of the drawings.

As will be appreciated, a block of the type shown in FIG. 11 of the drawings, in which the shaped body comprises two portions 7 and 8, may be produced by firstly forming a portion 7 having tablet 2 embedded therein by any of the above decided casting/moulding, compression or extrusion processes and bonding thereto a second portion 8, which also may be formed by any one of the above described processes.

The shaped body of a block in accordance with the invention comprises a cleaning composition which contains at least one surface active agent and which is slow dissolving as discussed above.

Whilst it is possible to form the shaped body of a single surface active material which has the desired solubility characteristics (for example a sucrose surfactant) it has been found in practice that it is generally preferable to formulate the cleaning composition forming the shaped body from one or more readily-soluble surface active agents in admixture with one or more solubility control agents.

One class of solubility control agents comprises materials of lower solubility than the readily-soluble surface active agent component. Such solubility control agents may vary in nature from substantially wholly water-soluble materials to materials having a low solubility in water. The relative amounts of readily water-soluble active agent component and solubility control agent component will vary depending upon the relative solubilities of each and in general it may be said that the greater the solubility of the control agent the more will be required and vice versa.

Examples of substantially insoluble solubility control agents include paradichlorobenzene, waxes (for example natural waxes such as beeswax or carnuaba wax, or petroleum waxes), long chain fatty acids and alcohols and esters thereof (e.g. stearic acid, stearyl alcohol, behenic acid, methyl stearate and stearyl acetate) and fatty alkylamides. Such insoluble solubility control materials are suitably present in the cleaning composition forming the shaped body in amounts of from 1 to 50% by weight, preferably from 5 to 30% by weight of the composition.

Solubility control agents of limited solubility in water include various classes of nonionic surface active agents, for example fatty acid alkanolamides (e.g. fatty acid mono- and di- ethanolamides) low ethoxylates (for example containing up to 5 ethoxylate units per mole) of such fatty acid alkanolamides; low ethoxylates of fatty acids, fatty alcohols and alkylphenols (e.g. containing up to 8 ethoxylate units/mole) and ethylene oxide/propylene oxide block copolymers having a relatively high propylene oxide polymer content. Many such materials are known and are commercially available and are described, for example, in "Surfactants U.K." (published by Tergo-Data of Darlington, 1979, G. C. Hollis editor). Similarly, anionic, cationic and amphoteric surface active agents, e.g. long chain soaps may be employed as solubility control agents.

In general, the solubility control agents having a limited solubility in water are suitably present in the cleaning compositions in amounts of from 5 to 90% by weight, preferably from 15 to 60% by weight and more preferably in amounts of from 15 to 45% by weight.

Another class of solubility control agents comprises clays and water-soluble or water-dispersible gel-forming polymers, that is polymers which upon dissolution or dispersion in water form a gel which upon dilution with water is dispersed or dissolved to form a free-flowing gel. Such polymers may be wholly synthetic or may be semi-synthetic materials derived from natural polymers, e.g. chemically modified celluloses. Alternatively such gel-forming materials may be gums such as xanthan gum or may be materials such as alginates or caragheenates. Such solubility control agents are particularly suitable for use when the shaped body is manufactured by a compression process, as is discussed more fully in British patent specification No. 2021143, but may also be used when the shaped body is prepared by a melt/casting process (as described in British patent specification No. 2061996) or by an extrusion process. In any event, such solubility control agents are suitably employed in an amount of from 0.5 to 75% by weight, preferably from 1 to 70%, by weight, more preferably from 5 to 60% by weight, based on the total weight of the ingredients of the shaped body.

Suitable readily water-soluble surface active agents for use in the cleaning compositions forming the shaped body, in combination with a solubility control agent, include nonionic surface active agents such as ethoxylated fatty alcohols, fatty acids or alkylphenols. Many such nonionic readily water-soluble surface active agents are known and commercially available and are described, for example, in the "Surfactants U.K." work referred to above.

Other readily soluble surface active agents which may be employed include anionic, cationic and amphoteric surface active agents.

Suitable anionic surface active agents include, for example, alkali metal salts of alkyl substituted benzene sulphonic acids, alkali metal salts of long chain fatty sulphates, alkali metal ether sulphates derived from alcohols and alkyl phenols, alkali metal sulpho- succinates, alkali metal sarcosinates and alkali metal taurides. Suitable cationic surface active agents include quaternary ammonium bromides and chlorides containing a long chain alkyl group such as, for example, Cetrimide or benzalkonium chloride. Suitable amphoteric surface active agents include so-called "betaine" type and imidazoline type surface active agents.

The surface active agent component of the cleaning composition may comprise one surface active agent or may comprise a mixture of compatible surface active agents.

It is generally preferred to employ the nonionic surface active agents as surface active agent component of the cleaning composition, when the shaped body is produced by a casting/moulding operation, since these may be melted at low temperatures and are thus suitable for manufacturing the blocks by the moulding/casting process described above. Anionic surface active agents are generally higher melting materials and thus, if employed in a composition used to form the blocks by the casting/moulding method described above, should be used in admixture with a solubility control agent which is itself capable of being melted at relatively low temperatures, for example a nonionic surface active agent solubility control agent.

When the shaped body is prepared by a compression or extrusion process any surface active agent may be used provided, of course, that is capable of being obtained in a form suitable for use in the process, i.e. in dry particulate form for use in a compression process.

The relatively soluble surface active component of the cleaning composition used to form the shaped body is suitably present in the cleaning composition in amounts of from 5 to 95% by weight, preferably from 10 to 80% by weight, more preferably from 20 to 60% by weight.

The cleaning compositions forming the shaped body may, contain other ingredients. In particular it has been found useful to include in the cleaning composition a water-softening agent such as an alkali metal polyphosphate (for example sodium tripolyphosphate or sodium hexametaphosphate) since such assist in the cleaning action of the composition and also serve to inhibit the formation of lime scale deposits in the lavatory bowl. Such water-softening agents are suitably present in the cleaning composition in amounts of from 10 to 50% by weight, preferably from 15 to 40% by weight.

The cleaning composition may also contain a perfuming agent, such as, for example, pine oil or paradichlorobenzene, and such perfuming agent is suitably present in an amount of up to 20% by weight, preferably up to 10% by weight.

Further the cleaning composition may also contain inert fillers or builders such as water-soluble inorganic salts, for example sodium chloride or sodium sulphate, suitably in amounts of from 10 to 60, preferably from 15 to 50% by weight, based on the weight of the composition.

Free-standing lavatory cleansing blocks often contain a dyestuff or other colouring agent which imparts a coloration to the water in the cistern (and in the bowl). The block of the invention may also contain a colouring agent but it should be noted in this connection that dyestuffs may be bleached by the bleaching agent liberated from the bleaching agent tablet and so will provide little or no or only a transitory coloration to the flush water. If it is desired to impart coloration to the flush water, it is generally preferable to employ, as colouring agent, a more bleach-tolerant colouring agent such as Direct Blue 87. Such colouring agents, when employed, are suitably present in the cleaning composition in amounts of up to 20% by weight of the cleaning composition.

If the block is so formulated that the bleach tablet has a slightly shorter effective life than the shaped body any dye released after the end of the life of the bleach tablet will not be bleached and this may serve as an indication of the end of the effective life of the block. When the shaped body contains a dyestuff it is not necessary that all the body contain a dyestuff and thus, in a block of the type shown in FIGS. 11 and 12 of the drawings, the portion 8 of the shaped body not in contact with the bleach tablet may contain a dyestuff, the other portion 8 not containing any dyestuff. Alternatively a block in accordance with the invention not containing any dyestuff may be used in conjunction with a conventional free-standing block, the material of which contains a dyestuff. In this case the block of the invention may be sold in a pack also containing the conventional free-standing block. The conventional block may be produced by any one of the casting/moulding, compression or extrusion processes discussed above.

The end of the effective life of the block may be indicated to the user by a lack of foam produced on flushing the toilet. In order to achieve this an appropriate selection of surface active agents, possibly in connection with a foam booster, may be desirable.

Suitable bleaching agents for use in the bleach tablet include one or more of solid halogen-release agents such as halogenated isocyanuric acid or alkali metal salts thereof, chlorinated dimethyl hydantoin and solid alkali metal or alkaline earth metal hypochlorites such as lithium or calcium hypochlorite. Other bleaching agents which may be employed are peroxy bleaching agents, such as alkali metal perborates in association with suitable activators therefor.

The bleach tablet is preferably a compressed tablet but may be a controlled dissolution tablet containing the bleaching agent and one or more solubility-control agents which may be produced by a casting/moulding or extrusion process.

As noted above, the tablet should desirably be of such a character that it releases bleaching agent over substantially the same period of time as that in which the shaped body is dissolved away. The rate of release of bleaching agent from the tablet may be controlled by selecting the nature of the bleaching agent, the degree of compression used to form a compressed tablet (in general the higher the pressure the slower the rate of release of bleaching agent) and/or by incorporating in the tablet a solubility control agent functioning in the same manner as the solubility control agent discussed above in connection with the shaped body.

It is, in this case, generally preferably to employ the more insoluble solubility control agents and it may be noted that such solubility control agents may also serve as an aid in the preparation of compressed tablets, for example as a tablet lubricant or binder. Thus, for example, salts of long chain fatty acids, for example sodium stearate, may serve both as solubility control agent and as tablet lubricant/binder.

Where the bleaching tablet is provided with a protective film coating, as shown in FIG. 2 of the drawings. this may be formed by wrapping the tablet in a preformed film of readily water-soluble or water-dispersible material such as polyvinyl alcohol, a polyethyleneoxide, or a cellulosic material such as paper or a water-soluble or dispersible starch derivative. Alternatively the tablet may be coated from a solution or dispersion of an approrpriate water-soluble or water-dispersible film forming material in a volatile organic solvent or dispersion medium.

The whole of the block may itself be provided with a coating or wrapping of readily water-soluble or water-dispersible material, for example it may be wrapped with a coating of a polyinvl alcohol film.

The invention also provides a method of cleaning a lavatory or urinal which comprises immersing in the cistern thereof a cleansing block in accordance with the invention.

In order that the invention may be well understood the following examples are given by way of illustration only. In the examples all parts and percentages are by weight unless otherwise stated.

The following examples 1–22 are examples of compositions suitable for forming shaped bodies of the blocks in accordance with the invention. The composition given in Examples 1–11 are suitable for the products of shaped bodies by a casting/moulding operation, those of Examples 12–17 for a compression process and those of Examples 18–22 for an extrusion process.

EXAMPLE 1

| | |
|---|---|
| CME (Coconut monoethanolamide-Empilan CME) | 25.5% |
| CDE (Coconut diethanolamide-Empilan CDE) | 10.5% |
| AE/50EO (Fatty Alcohol ethoxylate containing 50 moles EO per | 19.0% |

-continued

| | |
|---|---|
| mole - Empilan KM 50) | |
| EO/PO (Ethylene oxide/ propylene oxide block copolymer-Synperonic PE 30/80) | 10.0% |
| STP (Sodium tripolyphosphate) | 25.0% |
| Perfume | 10.0% |

EXAMPLE 2

| | |
|---|---|
| EO/PO | 10.0% |
| AE/3EO (Fatty alcohol ethoxylate containing 3 moles EO per mole - Ethylan D 253) | |
| Sodium carbonate | 40.0% |
| Distilled fatty glycerides (Dimodan PM) | 5.0% |
| Poly (ethylene oxide) | 20.0% |
| Perfume | 10.0% |

EXAMPLE 3

| | |
|---|---|
| LDE (Lauric diethanolamide-Empilan LDE) | 25.0% |
| AE/SOEO | 25.0% |
| STP | 25.0% |
| Stearic acid | 15.0% |
| Perfume | 10.0% |

EXAMPLE 4

| | |
|---|---|
| AE/50EO | 40.0% |
| AE/6EOA (Fatty alcohol ethoxylate containing 6 moles EO per mole - Texafor A6) | 30.0% |
| Stearic acid | 5.0% |
| STP | 25.0% |

EXAMPLE 5

| | |
|---|---|
| AE/50EO | 39.0% |
| AE/6EOB (Fatty alcohol ethoxylate containing 6 moles EO per mole - Empilan KM 6) | 27.5% |
| EO/PO | 2.5% |
| Cetrimide B.P. | 1.0% |
| Stearic acid | 5.0% |
| STP | 25.0% |

EXAMPLE 6

| | |
|---|---|
| AE/50EO | 64.0% |
| AE/6EOB | 32.5% |
| EO/PO | 2.5% |
| Cetrimide B.P. | 1.0% |

EXAMPLE 7

| | |
|---|---|
| AE/20EO (Fatty alcohol ethoxylate containing 20 moles EO per mole - Genapol 0.200) | 80.0% |
| Xanthan gum (Kelzan) | 20.0% |

EXAMPLE 8

| | |
|---|---|
| HEC (Hydroxyethyl cellulose-Tylose 100,000 YP) | 10.0% |
| CME | 30.0% |
| AE/20EO | 60.0% |

EXAMPLE 9

| | |
|---|---|
| Polymethyl vinyl ether/maleic anhydride condensate (Gantrez AN 169) | 10.0% |
| CME | 30.0% |
| AE/20EO | 60.0% |

EXAMPLE 10

| | |
|---|---|
| Xanthan gum | 10.0% |
| AE/6EOB | 15.0% |
| AE/50EO | 45.0% |
| CME | 30.0% |

EXAMPLE 11

| | |
|---|---|
| Xanthan gum | 10.0% |
| CME | 30.0% |
| AE/20EO | 56.0% |
| Dye (Direct Blue 87 - Durazol Blue 20 GP) | 4.0% |

EXAMPLE 12

| | |
|---|---|
| Polyvinyl alcohol (Gohsenol KH 20) | 70.0% |
| Ethoxylated alkyl phenol (Ethylan N50) | 15.0% |
| Dye | 5.0% |
| Paradichlorobenzene | 5.0% |
| Cetrimide B.P. | 5.0% |

EXAMPLE 13

| | |
|---|---|
| HPMC (hydroxypropylmethyl cellulose - Celacol HPM 5000) | 10.0% |
| NDBS (sodium dodecyl benzene sulphonate - Nansa HS 80S) | 30.0% |
| Dye | 4.0% |
| Perfume | 2.0% |
| Sodium chloride | 52.0% |
| Cetrimide B.P. | 1.0% |
| Sip (Fumed Silica - Sipermat 22S) | 1.0% |

EXAMPLE 14

| | |
|---|---|
| HPMC | 5.0% |
| NDBS | 40.0% |
| LDE | 1.5% |
| Dye | 4.0% |
| Perfume | 3.0% |
| Sodium chloride | 43.5% |
| Cetrimide B.P. | 1.5% |
| Sip | 1.5% |

EXAMPLE 15

| | |
|---|---|
| HPMC | 5.0% |
| NDBS | 25.0% |
| LDE | 5.0% |
| Dye | 4.0% |
| Perfume | 2.0% |
| Sodium chloride | 57.0% |
| Cetrimide B.P. | 1.0% |
| Sip | 1.0% |

EXAMPLE 16

| | |
|---|---|
| HPMC | 1.0% |
| NDBS | 30.0% |
| Dye | 4.5% |
| Perfume | 5.0% |
| Sodium chloride | 48.0% |
| Centrimide B.P. | 1.5% |
| Sip | 5.0% |
| Magnesium stearate | 5.0% |

EXAMPLE 17

| | |
|---|---|
| HPMC | 10.0% |
| NDBS | 30.0% |
| Dye | 4.0% |
| Perfume | 5.0% |
| Sodium chloride | 46.5% |
| Cetrimide B.P. | 1.5% |
| Sip | 3.0% |

EXAMPLE 18

| | |
|---|---|
| ADBS Powder (Spray-dried built powder containing alkyl benzene sulphonate and phosphates, silicates and sulphates as builder/filler-Nansa UCA/SB) | 79.0% |
| Sodium stearate | 5.0% |
| Perfume | 10.0% |
| Germicide (o-benzyl-p-chlorophenol) | 1.0% |
| Dye | 5.0% |

EXAMPLE 19

| | |
|---|---|
| ADBS Powder | 80.0% |
| Sodium stearate | 6.0% |
| Perfume | 8.0% |
| Germicide | 1.0% |
| Dye | 5.0% |

EXAMPLE 20

| | |
|---|---|
| ADBS Powder | 69.0% |
| Sodium stearate | 5.0% |
| Perfume | 10.0% |
| Germicide | 1.0% |
| Dye | 5.0% |
| NDBS | 10.0% |

EXAMPLE 21

| | |
|---|---|
| NDBS | 25.0% |
| Sodium sulphate | 53.0% |
| Sodium stearate | 8.0% |
| Perfume | 8.0% |
| Germicide | 1.0% |
| Dye | 5.0% |

EXAMPLE 22

| | |
|---|---|
| NDBS | 20.0% |
| Sodium sulphate | 41.0% |
| AE/50EO | 15.0% |
| Perfume | 8.0% |
| Germicide | 1.0% |
| Dye | 5.0% |
| Sodium Stearate | 10.0% |

Examples of compressed bleach tablets are tablets A, B or C having the following formulae and weights.

| Tablet | Ingredients | Weight |
|---|---|---|
| A | Trichloroisocyanuric acid (Ficlor 91) | 20 gms |
| B | Trichloroisocyanuric (85%) acid Disodium dichloroisocyanurate (15%) (Ficlor clearon) | 20 gms |
| C | Calcium hypochlorite (90%) Sodium stearate (10%) | 30 gms |

We claim:

1. A lavatory cleansing block comprising a shaped body formed of a slow-dissolving cleaning composition containing at least one surface active agent and a tablet comprising a bleaching agent, the bleaching agent being embedded in or adhered to the shaped body.

2. A lavatory cleansing block as claimed in claim 1 having a weight of from 30 to 300 grams.

3. A lavatory cleansing block as claimed in claim 1 or claim 2 in which the bleach tablet is provided with a coating of a readily water-soluble or water-dispersible material to prevent direct contact of the tablet with the material of the shaped body.

* * * * *